US006976364B1

(12) United States Patent
Bengtsson

(10) Patent No.: US 6,976,364 B1
(45) Date of Patent: Dec. 20, 2005

(54) TEMPERATURE REGULATION OF A SPRAYED FLUID MATERIAL

(75) Inventor: Bengt-Göran Bengtsson, Brålanda (SE)

(73) Assignee: Advanced Flow Control AFC AB, Brålanda (SE)

( * ) Notice: Subject to any disclaimer, the term of this patent is extended or adjusted under 35 U.S.C. 154(b) by 43 days.

(21) Appl. No.: 10/787,633

(22) Filed: Feb. 26, 2004

Related U.S. Application Data

(60) Provisional application No. 60/450,526, filed on Feb. 26, 2003.

(51) Int. Cl.[7] ..... F25B 21/02
(52) U.S. Cl. ..... 62/3.7; 62/3.64
(58) Field of Search ..... 62/3.7, 126, 129, 62/3.2, 3.3, 3.64, 389; 222/146.6

(56) References Cited

U.S. PATENT DOCUMENTS

| | | | | |
|---|---|---|---|---|
| 4,998,502 A | | 3/1991 | Schucker | 118/667 |
| 5,104,512 A | * | 4/1992 | Gombocz et al. | 204/607 |
| 5,410,412 A | * | 4/1995 | Gombocz et al. | 356/417 |
| 5,483,799 A | * | 1/1996 | Dalto | 62/3.7 |
| 5,572,873 A | * | 11/1996 | Lavigne et al. | 62/3.62 |
| 5,989,285 A | * | 11/1999 | DeVilbiss et al. | 607/107 |
| 6,006,524 A | * | 12/1999 | Park | 62/3.7 |
| 6,009,712 A | * | 1/2000 | Ito et al. | 62/3.7 |
| 6,012,291 A | * | 1/2000 | Ema | 62/3.7 |
| 6,038,865 A | * | 3/2000 | Watanabe et al. | 62/3.6 |
| 6,094,920 A | * | 8/2000 | Kawase | 62/3.7 |
| 6,230,501 B1 | * | 5/2001 | Bailey et al. | 62/51.1 |
| 6,325,475 B1 | * | 12/2001 | Hayes et al. | 347/2 |
| 6,729,269 B2 | * | 5/2004 | Ott et al. | 123/41.31 |

FOREIGN PATENT DOCUMENTS

| | | | |
|---|---|---|---|
| JP | 361170813 A | * | 8/1986 |
| JP | 403125867 A | * | 5/1991 |

* cited by examiner

*Primary Examiner*—William E. Tapolcai
*Assistant Examiner*—Mohammad M. Ali
(74) *Attorney, Agent, or Firm*—Jeffrey Pearce

(57) ABSTRACT

The temperature of a flowing material, such as coating and filling materials, is regulated by having it pass through a metal block that is cooled or heated by adjacent thermoelectric elements. A temperature regulator uses, as inputs, a desired material temperature (T_ref) as well as one or more of a set of temperature signals including temperature signals measured at the inlet and outlet to the block, and internally within a cooling arrangement adjacent to the block. The temperature of the material downstream from the regulator, that is, the temperature to be regulated, is either measured directly or is estimated as a function of the other measured and input signals.

20 Claims, 4 Drawing Sheets

TEMPERATURE REGULATION OF A SPRAYED FLUID MATERIAL

CROSS-REFERENCE TO RELATED APPLICATIONS

This application claims priority of U.S. Provisional Patent Application No. 60/450,526 filed 26 Feb. 2003.

BACKGROUND OF THE INVENTION

1. Technical Field

This invention relates to an arrangement for spraying coating and filling materials such as paint, sealants, glue, insulating material, etc.

2. Background Art

Coating and filling materials are sprayed onto work surfaces in many industries. In many applications, it is important or at least beneficial to be able to regulate the temperature of the sprayed material. Many coatings and fillers work best when sprayed at temperatures in specific temperature ranges, for example 25–30 degrees Celsius, to provide the best adhesion or proper viscosity. Regulating the temperature of typical coating materials is made difficult not only by the nature of the materials themselves, but also by the work environment, the spraying apparatus, and the spraying procedure.

In the automotive industry, for example, such "complex" materials as PVC (sometimes even including a high density of small glass spheres), epoxy, and rubber-based bitumen are often sprayed, using robot-mounted guns, as protective coatings and fillers onto or into such parts as wheel wells, door frames, underbodies, etc. The spray profile is often uneven, with both high and low flow rates, frequent starts and stops, and often with idle times long enough that the ambient temperature—which often differs by as much as 15–40 degrees Celsius—can affect the temperature of the material to be sprayed.

One common way to regulate the temperature of the sprayed material is to pass it through a conduit that is externally cooled or heated by water. One common drawback of such conventional arrangements is that they are usually slow, which limits their ability to regulate the temperature of material flowing at relatively high rates. Another drawback is that these systems are often bulky, which makes them difficult to mount near or on a robot-held spray gun.

What is needed is therefore an arrangement that allows for quick and accurate regulation of the temperature even of such complex sprayed materials. It would also be advantageous if the arrangement could be made compact enough that it is convenient to use with a robot. This invention provides such an arrangement.

SUMMARY OF THE INVENTION

The invention involves an arrangement for regulating the temperature of a flowing material, such as coatings and fillers made of, for example, PVC, epoxy, and bitumen, that are to be sprayed onto or into work surfaces or openings. The arrangement includes a material supply arrangement that delivers the material under pressure; a temperature regulator that receives the material under pressure from the supply arrangement; and a dispensing device that receives the flowing material from the temperature regulator and dispenses the flowing material.

The temperature regulator comprises a thermally conductive metal block that has a material inlet and a material outlet; at least one flow channel that extends in a direction of flow through the metal block between the material inlet and the material outlet, the material flowing through the at least one flow channel; electrically controllable thermoelectric elements (such as Peltier elements) adjacent to and in thermal contact with the metal block; at least one temperature sensor generating a measured temperature signal; and an element controller electrically connected with the thermoelectric elements and having, as input signals, at least a desired temperature signal (T_ref) and the at least one measured temperature signal, the element controller regulating the electrical state of the thermoelectric elements by generating a temperature control signal (T_c) and applying it to the thermoelectric elements as a function of the input signals to cause the thermoelectric elements to thermally influence the material flowing through the metal block.

In systems in which the material to be sprayed needs to be cooled, the arrangement further preferably comprises a cooling arrangement for cooling the thermoelectric elements.

The regulator uses, as inputs, temperature signals measured using sensors at different places either in the structure of the block, for example, at the inlet and/or outlet, of the cooling arrangement, and/or in the material flow itself. Accordingly, any of all of the following may be included: an inlet temperature sensor generating an inlet temperature signal (T1) corresponding to the temperature of the metal block adjacent to the material inlet; an outlet temperature sensor generating an outlet temperature signal (T2) corresponding to the temperature of the metal block adjacent to the material outlet; and an internal temperature sensor generating an internal temperature signal (T3) corresponding to the temperature of the cooling arrangement at a point adjacent to the thermoelectric elements.

A downstream temperature signal (T4) corresponding to the temperature of the flowing material after it exits the metal block, is preferably also either measured directly by a corresponding sensor, or an estimator is included for the purpose of generating an estimated downstream material temperature signal (T4_est) that can be used as the downstream material temperature value. In one embodiment of the invention, the estimator is provided for forming the estimated downstream temperature signal (T4_est) as a weighted linear combination of the inlet, internal, outlet, and control signal temperature signals (T1, T3, T2, T_c).

The invention preferably also includes circuitry for generating the desired temperature signal (T_ref) selectively as either an input set-point temperature signal (T_set) or as a function of a temperature error signal (T4_e) corresponding to the difference in temperature between the set-point temperature signal (T_set) and a downstream material temperature value.

The invention is particularly advantageous for use in a spraying system, in which case it further comprises a dosing unit that causes a flow of the material to the dispensing device in accordance with a pressure reference signal. The dosing device is then preferably located in the path of flow of the material between the temperature regulator and the dispensing device.

DETAILED DESCRIPTION

The invention is particularly advantageous for regulating the temperature of materials commonly sprayed during the process of manufacturing automobiles. It is also in this area of application that a prototype of the invention has been successfully developed. The invention is not limited to this field of use, however, and will provide superior temperature regulation for a wide range of sprayed materials in different industries.

Figure 1:
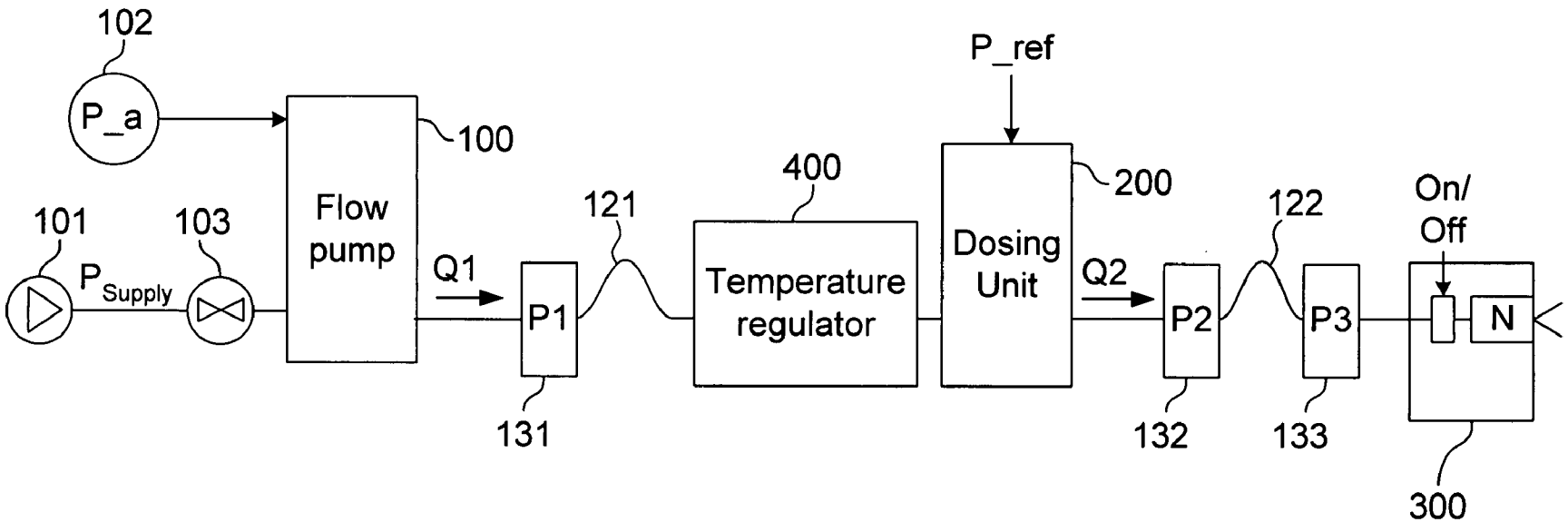
FIG. 1 illustrates the main components and parameters of a spray-control system according to the invention.

See FIG. 1, which illustrates the general configuration of a conventional system for spraying materials such as PVC, epoxy, bitumen, etc. The desired coating or filling material is supplied in any known manner, such as using a drum pump, to a flow pump 100, which acts as a booster pump. In the illustrated embodiment, the material is supplied at pressure $P_{Supply}$ from any conventional supply 101. In one prototype of the invention, the flow pump 100 was a pressure-driven flow pump of the 4-ball type. In the prototype, the flow pump 100 was controlled using a conventional proportional valve pump 102 that delivered an output air pressure P_a to drive the flow pump 100. Other arrangements may be used instead of a 4-ball pump, however. Any conventional pump (including a gear-driven pump or even a double-dosing pump) may be used as the flow pump 100.

It is advantageous to include a controlled inlet valve 103 between the supply and the flow pump 100. During periods of low use the supply can then be opened and shut off so that a dosing unit 200 (see below) will be filled during spraying, after which it can operate as a pure accumulator for some time. When the volume in the dosing unit has dropped below a predetermined level, the supply may once again be opened to fill the dosing unit.

Material is fed at a flow rate Q1 via a first hose 121 to a single-action pump that forms a dosing unit or "active accumulator" 200. The pressure P1 at the flow pump (upstream) end of the hose 121 may be measured using a conventional transducer 131.

The dosing unit 200 delivers material at a flow rate Q2 via a second hose 122 to a spray gun 300. For purposes of pressure regulation, pressure may be measured at both the upstream and downstream ends of the second hose, which is typically 1–3 meters long; in FIG. 1, the upstream pressure P2 is measured using transducer 132 and the downstream pressure P3 is measured using transducer 133.

In the prototype of the invention, the dosing unit 200 was of the type known as a "shot meter." The dosing unit 200 is preferably pressure-regulated to the desired spray pressure. In FIG. 1, P_ref indicates the regulating pressure signal. The reference pressure P_ref applied to the dosing unit may be determined using known methods. U.S. Pat. No. 5,182,704 (Bengtsson, 26 Jan. 1993, "Method and Device for Regulating the Spraying of Coating Materials") discloses one suitable method. The disclosed method may also be used to improve the regulation of the flow pump 100.

The invention is advantageous even in applications in which the spray gun 300 is maneuvered by a robot. In such applications, the dosing unit 200 may be located at the robot itself, which, in normal installations, means that the first hose 121, between the flow pump 100 and the dosing unit 200, will typically be 5–15 m long. Note that the dosing unit 200 is preferably located close to the spray gun 300 (for example within 2 m) regardless of whether robotic spraying is involved. In a typical installation the material will therefore flow through about 6–18 meters of hose. Because the thermal insulation of these hoses is usually either poor or non-existent, the material is readily prone to being heated (or, less often, cooled) by the surrounding environment. If no spraying is taking place, for example, then the material will typically reach a +40 degree Celsius ambient temperature in around 30 minutes.

The spray gun 300 may be of any type suitable for the given application, with a nozzle N and an on/off valve.

The present invention relates primarily to the temperature regulator 400. In FIG. 1, the temperature regulator 400 is placed in-line immediately upstream of the dosing unit 200. The advantage of this placement is that it allows the dosing unit to compensate for any pressure drop that the temperature regulator 400 itself might cause. The regulator 400 may be located elsewhere in the flow path, however. For example, in order to reduce or eliminate the temperature changes caused by the dosing unit 200 or in the second hose 122, one might instead mount the temperature regulator 400 on the gun 300, or (if space and weight limitations do not permit this) between the dosing unit 200 and the gun 300.

Figure 3:
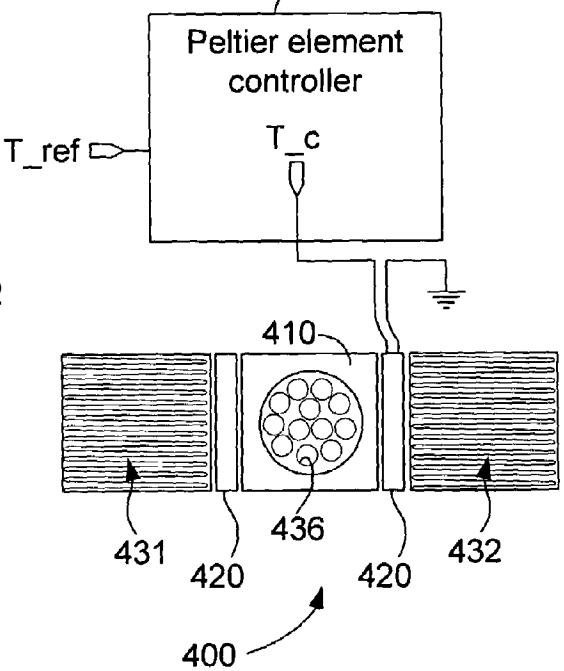
FIG. 3 is an end view of the temperature regulation arrangement as well as a block diagram illustrating temperature-regulating circuitry.
Figure 2:
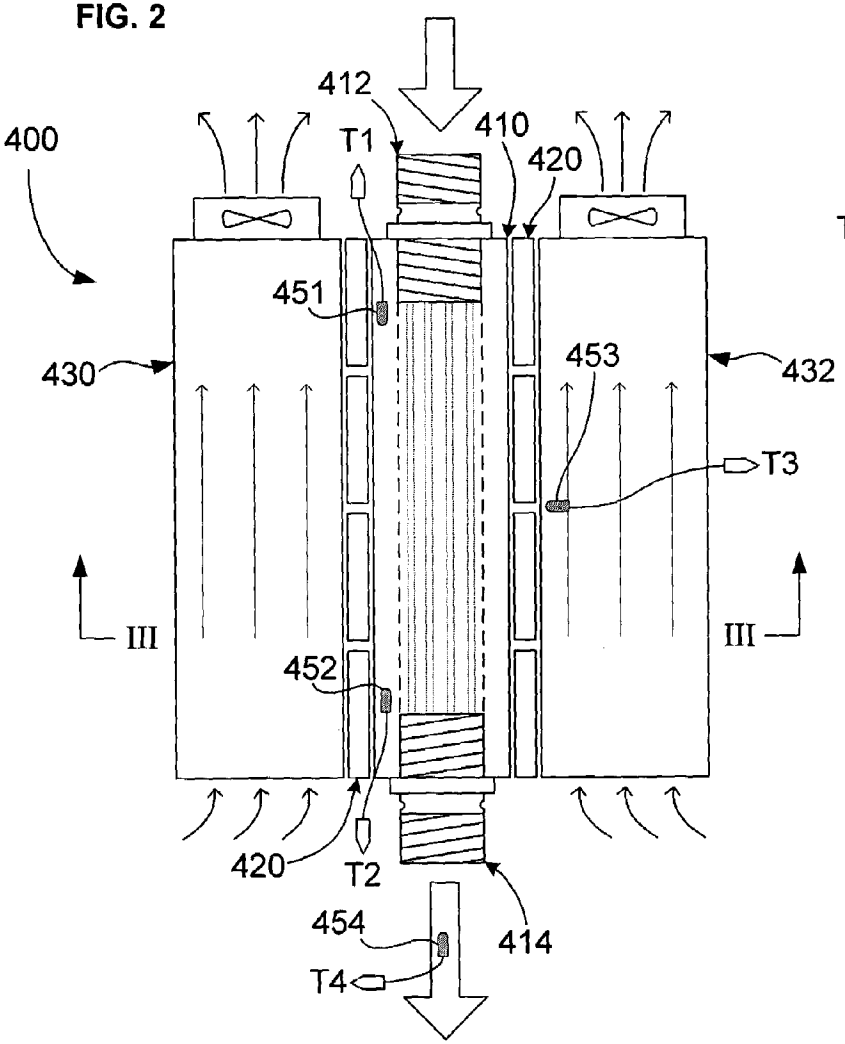
FIG. 2 is a partially cut-away view of a temperature regulation arrangement according to the invention.

FIGS. 2 and 3 are top and end views, respectively, of a preferred embodiment of the invention as was used successfully in a prototype. In broadest terms, the primary embodiment of the invention involves a temperature regulator 400 that comprises a multi-channel, thermally conductive metal block 410 through which the material flows and which is cooled or heated by several electronically controlled Peltier (or other thermoelectric) elements 420. The higher the thermal conductivity the metal block 410 has, the better the invention will work. For most applications, common and easy-to-machine metals such as copper and aluminum work satisfactorily.

The Peltier elements 420 are mounted on or very near the metal block 410 using any conventional bracket or mounting methods. Inlet and outlet fittings 412, 414, are also shown in FIG. 2, which respectively connect the temperature regulator 400 to the first hose 121 and to the dosing unit 200 by any conventional means, such as another length of hose.

In one working implementation of the invention, temperature was measured at at least four different positions, as illustrated in FIG. 2:

- a first temperature sensor 451 located in the block 410 near the material inlet to provide a signal T1 indicating the temperature there;
- a second temperature sensor 452 located in the block 410 near the material outlet to provide a signal T2 indicating the temperature there;
- a third temperature sensor 453 located in one of a group of cooling units, such as flanges 430, 432 near the middle vertically (viewed as in FIG. 2) and near the Peltier elements 420, generating a temperature signal T3; depending on placement of the sensor 453, T3 can be used to indicate an ambient temperature, that is, the temperature of the space surrounding the Peltier elements and the regulator block; and
- a fourth temperature sensor 454 located in the material itself downstream of the unit (temperature regulator) 400 and generating a temperature signal T4; note that, to reduce dead time, it would be possible to mount the fourth temperature sensor 454 (or another temperature sensor) in the spray gun 300 itself. Below, in conjunction with the discussion of FIG. 5, a feature is described that allows the system to estimate the downstream material temperature T4 even in systems that lack the fourth temperature sensor 454.

In a simple embodiment of the invention, it is possible to measure only the temperature of the output material, either at the position of the temperature sensor 452 or of the temperature sensor 454. Such a single temperature feedback signal may be adequate for certain applications and temperature regulators (for example, of the PID type), although, in one implementation of the regulation system (see FIGS. 4 and 5, and the related discussion), all four signals T1–T4 were used to improve the results, with an option to estimate T4 in implementations in which the fourth sensor 454 is either not included or for some other reason not to be considered.

Discovered in 1834 by the French clock-maker after whom it is named, the Peltier effect is the well-known phenomenon that whenever current passes through a circuit of two conductors, the junction of the two conductors will either absorb or release heat depending on the polarity of the applied current. In other words, as current passes through the two conductors, a temperature differential arises between the two, and the differential will be positive or negative depending on drive current polarity. A Peltier element thus acts as a d.c.-driven heat pump, the amount of heat pumped being in direct proportion to the current supplied. The temperature differential created by the Peltier effect is increased when the conductors of the thermocouple have different conductivity. In modern thermoelectric modules such as commercially available Peltier elements, doped semiconductor materials are used instead of the earlier dissimilar metals. Common Peltier elements comprise serried ranks of a large number of small semiconductor junctions soldered together and mounted between two thermally conductive ceramic plates.

Peltier elements behave approximately like a simple resistive device in that their current consumption is roughly linearly related to the voltage applied over them. The relationship is not exactly linear, however, because the resistance of a Peltier element component increases with temperature. The relationship between current and temperature can, however, be established through conventional experimentation and is usually supplied as part of the specifications of the commercially available elements.

Figure 4:
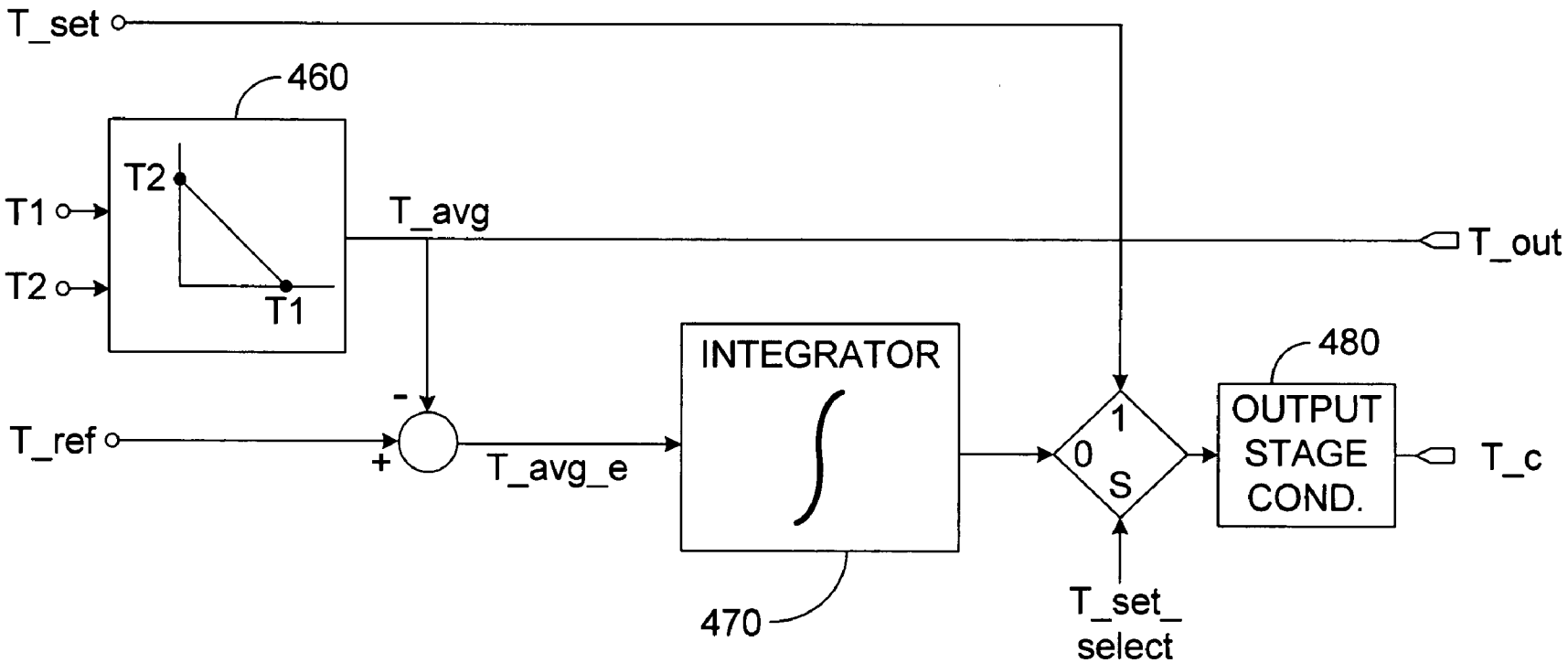
FIGS. 4 and 5 are simplified block diagrams of two stages of a PID regulator used in one implementation of the invention.
Figure 5:
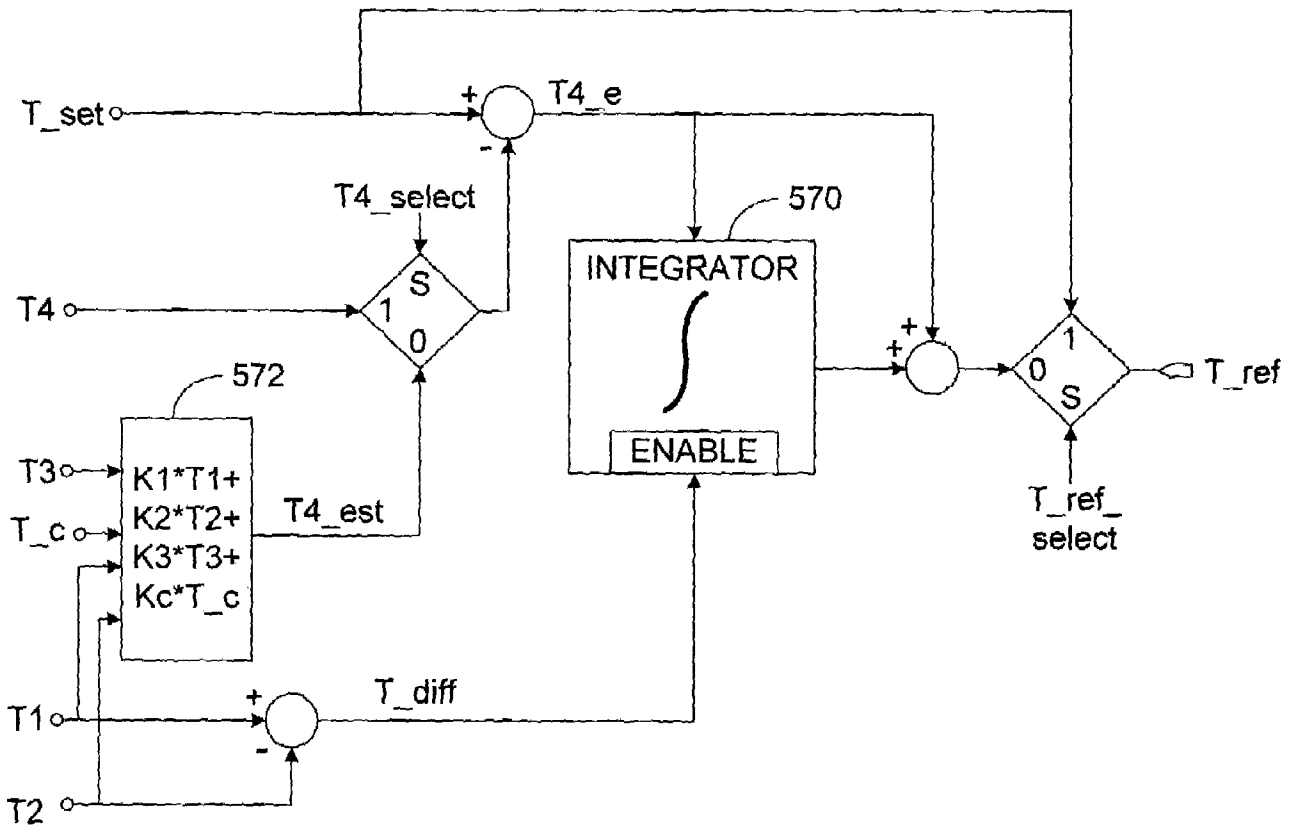

According to the invention, current to the Peltier elements 420 (and thus their temperature differential) is controlled using a controller 422, which adjusts the current to so that the output temperature of the material to be sprayed is as close as possible to a reference temperature T_ref, which may be set using any conventional input device. Different control circuits may be used in the controller. The inventor found that a cascaded or non-cascaded PID regulator performed satisfactorily in a prototype. An example of such a regulator is illustrated in FIGS. 4 and 5 and is discussed below.

The output of the controller 422 will be a direct current, which is applied to the Peltier elements 420. The controlling signal is shown as the signal T_c. In a prototype of the invention, opposing pairs of the elements were connected in series, but with all the pairs connected in parallel. Only two main leads were therefore necessary from the controller 422 to the Peltier elements 420. Assuming that the Peltier elements 420 are substantially identical electrically, this means that the same current is applied to all the elements 420. This will be satisfactory in most applications, but it is not necessary according to the invention. Rather, it would be possible to drive the elements (or element pairs) with different currents to create a cooling gradient over the length of the block 410 if this were preferred in a given application. Separate leads (or resistors connected in series) should then be provide to the various elements (or pairs).

In most cases, the material to be sprayed needs to be cooled. The current supplied to the Peltier elements 420 should therefore have such a polarity that the surface facing the metal block 410 is kept colder than the opposite surface, which will gain the heat that the inner surfaces give up, as well as the heat extracted via the metal block 410 from the flowing material and heat arising from loss within the Peltier elements themselves.

Cooling units 430, 432 are therefore preferably included adjacent to the outer surfaces of the Peltier element 420. In the illustrated, preferred embodiments, the cooling units 430, 432 are standard air-cooled, fan-ventilated heat exchangers with layers of fins, flanges or ribs such as in a radiator. Other cooling arrangements may of course be used instead, including those that use a liquid coolant. Such arrangements will typically add bulk and complexity, however.

In FIG. 3, the cooling units 430, 432 are shown as being laterally opposed to one another, on either side of the metal block 410. This is of course a design choice—the placement, orientation and even number of the cooling units can be varied depending on the needs of any given implementation of the invention and can be chosen using know design methods.

If the flowing material is to be heated then the polarity of the current applied to the Peltier elements 420 should be reversed. On the other hand, if it is known in advance that the flowing material is always to be heated, then thermally reversible devices such as Peltier elements will often not be the most efficient way to heat the block 410. In such case, conventional electrically driven heating elements may then be used instead and placed against the outer surface of the block. If heat is to be added to the flowing material using Peltier elements to heat the block 410, the air flowing through the cooling units will usually be sufficient to warm the outer, then cooler surfaces of the Peltier elements. Using Peltier elements and ventilated air cooling thus provides full reversibility (both cooling and heating) with no need of mechanical changes to the arrangement.

As FIG. 3 shows best, the material to be sprayed preferably runs through several lengthwise-extending bores or channels 436 (only one of which is labeled) in the metal block 420. The inlet and outlet fittings 412, 414 therefore act as manifolds. The number of channels may be chosen depending on the application and such factors as the expected maximum flow rate, the type of material, the dimensions of the block 410, the maximum anticipated degree of cooling required, etc. Note that the more channels there are, the greater the contact area between the flowing material and the metal block will be and the faster and more efficiently the temperature of the material can be changed.

Several features of the invention may be adjusted depending on the needs of a given installation of the invention. Flow speed, the material to be sprayed, the amount of cooling required, etc., all should be taken into account. Normal design methods may be used to adapt the illustrated embodiment to the needs of the installation. By way of example, however, a prototype of the invention suitable for spraying PVC to seal automobile chassis had the following particulars:

The block 410 was a copper rod with height-width-length dimensions of roughly 40×40×300 mm. A 25 mm deep threaded hole was drilled to a depth of roughly 40 mm at either end to receive the fittings 412, 414, which had exterior hose nipples. Twelve separated, parallel bores each 4 mm in diameter were drilled lengthwise through the block 410 to form the channels though which the PVC flowed. The actual dimensions of the block and the geometry and number of the bores can of course be adjusted to the needs of a given implementation of the invention by following normal design techniques.

Twelve commercially available Peltier elements with dimensions 40 mm×40 mm were mounted pair-wise on either side of the copper block 420. Direct current was supplied to the elements from a voltage source that delivered 0–24 V.

In theory, the thermal efficiency of the invention approaches 100% for extremely low flow rates of the material to be sprayed. This is not a practical situation, however, but the inventor determined that the efficiency of heat transport was about 52% for a flow rate of 10 ml/s and about 60% for a flow rate of 3 ml/s.

The invention thus proved itself to be much faster at cooling the flowing material than a conventional water-based system normally is —it was possible to change the temperature of the copper block 420 in only seconds, so that it was possible to follow the flow of the material and adjust its temperature very accurately.

As mentioned above, PID regulation of the control signal to the Peltier elements 420 has been successfully tested in an implementation of the invention. FIGS. 4 and 5 are simplified diagrams that illustrate two blocks of the circuit used in the controller 422 in the tested implementation.

FIG. 4 illustrates how a control temperature output signal T_c may be determined and used as the signal applied to the Peltier elements 420. In the implementation of the invention discussed here, four parallel sets of three series-connected Peltier elements 420 were driven by a 24 V square-wave signal of at least 10 kHz (so as not to damage the elements, since too low a frequency can cause mechanical stresses within the elements), with a maximum current of 10 A. T_c was thus the control signal to the existing pulsing circuits that drove the Peltier elements.

FIG. 4 also illustrates how the value T_out, representing the actual material temperature, can be determined. In one implementation of the invention, T_out was an analog output signal that could be used to drive any conventional display indicating the corresponding temperature.

In order to regulate the temperature of the material flowing through the regulator 400, values for two temperatures are required: the desired temperature and the actual temperature, especially of the downstream material flow, since it is this temperature at which material is actually delivered for use. The temperature of the material will normally change, however, as it passes though the block 410. This means that temperature regulation may apply to different points in the flow. Of course, one could simply take the temperature T2 of the material at the block outlet different as "the" actual temperature, but the inventor has discovered that a more sophisticated estimation will often provide more flexibility and better regulation. Moreover, since the temperature sensors 451 and 452 are preferably not directly in the flow of material, but rather in openings in the metal block 410 adjacent to the flowing material, neither T1 nor T2 will usually be the exact temperature of the nearby flowing material itself. In the illustrated embodiment of the invention, the output temperature T_out is therefore set to be a linear combination, in particular, a weighted average, of both T1 and T2, that is, of the temperatures measured at the inlet and the outlet of the block 410. Thus, in this embodiment, T_out=T_avg=(T1−T2)*K+T2, where T_avg indicates the weighted average.

Using this formula, if K=0.5, then T_avg will be the arithmetic mean of T1 and T2; K=0 causes T_out to be equal to the outlet temperature T2, and K=1 causes T_out to be equal to the inlet temperature T1. In other words, as K varies from 0.0 to 1.0, T_out will vary linearly from T2 to T1. It would of course be possible to form T_out as a non-linear function of T1 and T2, although this will probably introduce more design complication than desirable: Creating a module 460 that outputs the linear combination of T1 and T2 can be done with simple differencing components (with one additive and one subtractive input combined to form an output signal) and a gain element for K.

It is also possible for K to be set to a negative value, or to a value greater than 1.0, which creates a "virtual" temperature that in many cases will better correspond to the actual output temperature of the material. The best value for K in any given implementation of the invention can be chosen using normal design methods and tests.

The temperature control signal T_c is selected to be either the input set-point temperature signal T_set (optionally conditioned in any conventional manner in an output stage 480), or the integrated difference T_avg_e between T_avg and the input reference signal T_ref. T_set and/or T_ref may be chosen and entered using known methods and components. In FIG. 4, the conventional integrating portion of the PID regulator is labeled 470. Selection of either T_set or the integrated error T_avg_e is made using a Boolean selection signal T_set_select. In short, integration may be either selected or suppressed.

FIG. 5 illustrates how the temperature reference signal T_ref can be selectively determined. In this case, the selection is made between either the user- (or supervisory system-) entered set-point temperature T_set, or a calculated (using either analog or digital components) as a function of various ones of the measured temperature signals and the temperature control signal T_c.

In the simplest case shown in FIG. 5, if the Boolean selection signal T_ref_select is set to "1", then T_ref is set to T_set. On the other hand, if T_ref_select is set to "0" (of course the logical values could be switched if the respective inputs are), then T_ref is calculated as a function of other measured, calculated, or estimated temperature signals.

As in most regulators, an important value is the difference between what the regulated value should be (here, the set-point temperature T_set) and what it is (here the temperature T4 of the material after it has left the regulator). The difference between these two temperatures is an error signal T4_e, which may be used not only as a proportional regulation value (with suitable scaling using one or more conventional gain elements) but also, if enabled, as an input to an integrator 570. In the illustrated embodiment of the invention, the actual value for T4 is either measured, as T4 itself, or is estimated, as T4_est.

Note that the goal of the regulator is for the downstream material temperature T4 to be a desired temperature. As described above, however, an actual, accurate, directly measured value for T4 may not be available. The invention therefore preferably provides an option to operate in either case: If the Boolean selection signal T4_select is set to "1", then a measured (or otherwise externally determined) value of T4 is available and is used. The error T4_e is then simply the difference between T_set and T4 (with scaling as desired).

Assume now, however, that a reliable, direct measurement of T4 is unavailable. A value for T4 can then be estimated. In FIG. 5, this value is shown as T4_est, and is formed within an estimator 572 as a weighted linear combination of T1, T2, T3, and T_c. Consequently, if T4_select is set to "0" (again, the logical values and inputs can be switched), then T4_e=(T_set−T4_est), where $$T4_est=K1*T1+K2*T2+K3*T3+Kc*T_c$$

and K1, K2, K3 and Kc are weights (which may be negative and even zero, depending on signal availability and reliability) that can be chosen using known design methods given the expected flow rate of material through the block, the expected maximum required degree of cooling of the flowing material, and the mechanical and thermal properties of the regulator, as well as its dimensions. Of course, other estimation functions may be used within the estimator 572 to generate T4_est besides the linear combination given above: for example, non-linear, recursive, adaptive and/or stochastic estimation methods may be used.

Whether the integrator 570 is enabled depends on a difference value T_diff formed as the difference between T1 and T2; thus, T_diff=(T1−T2). If T_diff is greater than a predetermined threshold value, then it can be assumed that material is flowing through the regulator and that the regulator is actually operating to cool (or heat) the material; in this case, integration is preferably enabled, for the same reasons that integration is used in any PID regulators. If, however T_diff is less than the threshold value, then the integrator is preferably not enabled, since the results of its integration would not provide reliable and meaningful information; for example, if T1=T2, then either no material is flowing through the block 410, or no cooling/heating is taking place at all.

One advantage of the circuit arrangement shown in FIG. 5 is that it allows the regulator to dynamically change T_ref so as to regulate T4 to a desired value even if it is not possible to measure T4 directly.

FIGS. 4 and 5 together illustrate the regulator as a cascaded PID regulator. This is not necessary; rather, it would be possible to implement the regulator 400 as a non-cascaded, that is, single-stage regulator using a single integrator. For example, it would be possible to combine the module 460 and the estimator 572 into a single component group (or software code block) and then to combine their outputs into a single input signal to a single integrator.

In both FIGS. 4 and 5, various conventional signal-processing components and sub-circuits have been omitted for the sake of clarity. Such conventional components and sub-circuits include gain elements and limiters, to condition and scale various signals, low-pass filters to help suppress noise, etc. The inclusion, selection and tuning of such circuitry is well within the skill of control systems engineers. Similarly, the internal components of the integrators are not described here because such components are also well understood and widely used and can be designed using conventional techniques. Moreover, although the implementation of the invention tested by the inventor used analog components, it would of course be possible to instead digitize the various input signals such as T_ref, T1−T3 and (if included) T4, to perform the various described functions (such as addition, subtraction, multiplication, integration, etc.) using known digital signal processing techniques, and then to convert the control signal T_c to analog form for driving the Peltier elements. Such conversion of an analog regulation system into a digital equivalent is well understood.

What is claimed is:

1. An arrangement for regulating the temperature of a flowing material comprising:

a supply arrangement delivering the material under pressure;

a temperature regulator receiving the material under pressure from the supply arrangement;

a dispensing device that receives the flowing material from the temperature regulator and dispenses the flowing material;

in which:

the temperature regulator comprises:

a thermally conductive metal block that has a material inlet and a material outlet;

at least one flow channel extending in a direction of flow through the metal block between the material inlet and the material outlet, the material flowing through the at least one flow channel;

electrically controllable thermoelectric elements adjacent to and in thermal contact with the metal block;

at least one temperature sensor generating a measured temperature signal;

an element controller electrically connected with the thermoelectric elements and having, as input signals, at least a desired temperature signal (T_ref) and the at least one measured temperature signal, the element controller regulating the electrical state of the thermoelectric elements by generating a temperature control signal (T_c) as a function of the input signals to cause the thermoelectric elements to thermally influence the material flowing through the metal block.

2. An arrangement as in claim 1, in which the thermoelectric elements are Peltier elements.

3. An arrangement as in claim 1, further comprising a cooling arrangement for cooling the thermoelectric elements.

4. An arrangement as in claim 3, further comprising:

an internal temperature sensor generating an internal temperature signal (T3) corresponding to the temperature of the cooling arrangement at a point adjacent to the thermoelectric elements, the internal temperature signal (T3) forming an additional one of the input signals to the element controller.

5. An arrangement as in claim 1, further comprising circuitry for generating the desired temperature signal (T_ref selectively as either an input set-point temperature signal (T_set) or as a function of a temperature error signal (T4_e) corresponding to the difference in temperature between the set-point temperature signal (T_set) and a downstream material temperature value.

6. An arrangement as in claim 5, further comprising:

a downstream temperature sensor generating a measured downstream temperature signal (T4) corresponding to the temperature of the flowing material after it exits the metal block, the downstream temperature signal (T4) forming an additional one of the input signals to the element controller;

in which the measured downstream temperature signal is the downstream material temperature value.

7. An arrangement as in claim 5, further comprising:

a cooling arrangement for cooling the thermoelectric elements;

an inlet temperature sensor generating an inlet temperature signal (T1) corresponding to the temperature of the metal block adjacent to the material inlet;

an outlet temperature sensor generating an outlet temperature signal (T2) corresponding to the temperature of the metal block adjacent to the material outlet;

an internal temperature sensor generating an internal temperature signal (T3) corresponding to the temperature of the cooling arrangement at a point adjacent to the thermoelectric elements;

the inlet, internal and outlet temperature signals (T1, T3, T2) forming additional ones of the input signals to the element controller; and an estimator generating an estimated downstream material temperature signal (T4_est), the estimated downstream temperature signal forming the downstream material temperature value.

8. An arrangement as in claim 7, in which the estimator is provided for forming the estimated downstream temperature signal (T4_est) as a weighted linear combination of the inlet, internal, outlet, and control signal temperature signals (T1, T3, T2, T_c).

9. An arrangement as in claim 5, in which the circuitry for generating the desired temperature signal (T_ref) includes an integrator selectively integrating the temperature error signal.

10. An arrangement as in claim 9, further comprising:

an inlet temperature sensor generating an inlet temperature signal (T1) corresponding to the temperature of the metal block adjacent to the material inlet;

an outlet temperature sensor generating an inlet temperature signal (T2) corresponding to the temperature of the metal block adjacent to the material outlet; and a summing element having, as an output, a difference signal (T_diff) corresponding to the difference between forming the difference between the inlet temperature signal (T1) and the outlet temperature signal (T2), the difference signal (T_diff) forming an input to the integrator such that the integrator is enabled only when the difference signal (T_diff) is at least as great as a threshold value.

11. An arrangement as in claim 10, further comprising:

selection circuitry within the element controller for selecting as the temperature reference signal (T_ref) either the input set-point temperature signal (T_set) or the output signal from the integrator combined with the internal error signal (T4_e).

12. An arrangement as in claim 1, further comprising:

an inlet temperature sensor generating an inlet temperature signal (T1) corresponding to the temperature of the metal block adjacent to the material inlet;

an outlet temperature sensor generating an outlet temperature signal (T2) corresponding to the temperature of the metal block adjacent to the material outlet;

circuitry for generating an averaged temperature error signal (T_avg_e) as a function of the difference between the desired temperature signal (T_ref) and a function of the inlet and outlet temperature signals (T1, T2);

an integrator having, as its input, the averaged temperature error signal (T_avg_e) and outputting a signal corresponding to the control signal temperature signal (T_c).

13. An arrangement as in claim 12, in which the function of the inlet and outlet temperature signals (T1, T2) is a weighted average.

14. An arrangement as in claim 12, selection circuitry within the element controller for selecting as an unconditioned temperature control signal either the input set-point temperature signal (T_set) or the output signal from the integrator.

15. An arrangement as in claim 14, further comprising an output stage circuit conditioning the unconditioned temperature control to generate the temperature control signal (T_c).

16. An arrangement as in claim 1, further comprising:

a cooling arrangement for cooling the thermoelectric elements;

an inlet temperature sensor generating an inlet temperature signal (T1) corresponding to the temperature of the metal block adjacent to the material inlet;

an outlet temperature sensor generating an inlet temperature signal (T2) corresponding to the temperature of the metal block adjacent to the material outlet;

an internal temperature sensor generating an internal temperature signal (T3) corresponding to the temperature of the cooling arrangement at a point adjacent to the thermoelectric elements;

the inlet, internal and outlet temperature signals (T1, T3, T2) forming additional ones of the input signals to the element controller.

17. An arrangement as in claim 1, further comprising a dosing unit causing a flow of the material to the dispensing device in accordance with a pressure reference signal;

in which the dosing device is located in the path of flow of the material between the temperature regulator and the dispensing device.

18. An arrangement for regulating the temperature of a flowing material comprising:

a supply arrangement delivering the material under pressure;

a temperature regulator receiving the material under pressure from the supply arrangement;

a dispensing device that receives the flowing material from the temperature regulator and dispenses the flowing material;

in which:

the temperature regulator comprises:

a thermally conductive metal block that has a material inlet and a material outlet;

at least one flow channel extending in a direction of flow through the metal block between the material inlet and the material outlet, the material flowing through the at least one flow channel;

electrically controllable thermoelectric elements adjacent to and in thermal contact with the metal block;

a cooling arrangement for cooling the thermoelectric elements;

at least one temperature sensor generating a measured temperature signal;

an element controller electrically connected with the thermoelectric elements and having, as input signals, at least a desired temperature signal (T_ref) and the at least one measured temperature signal, the element controller regulating the electrical state of the thermoelectric elements by generating a temperature control signal (T_c) as a function of the input signals to cause the thermoelectric elements to thermally influence the material flowing through the metal block;

an inlet temperature sensor generating an inlet temperature signal (T1) corresponding to the temperature of the metal block adjacent to the material inlet;

an outlet temperature sensor generating an inlet temperature signal (T2) corresponding to the temperature of the metal block adjacent to the material outlet;

an internal temperature sensor generating an internal temperature signal (T3) corresponding to the temperature of the cooling arrangement at a point adjacent to the thermoelectric elements;

the inlet, internal and outlet temperature signals (T1, T3, T2) forming additional ones of the input signals to the element controller; and circuitry for generating the desired temperature signal (T_ref) selectively as either an input set-point temperature signal (T_set) or as a function of a temperature error signal (T4_e) corresponding to the difference in temperature between the set-point temperature signal (T_set) and a downstream material temperature value;

circuitry for generating an averaged temperature error signal (T_avg_e) as a function of the difference between the desired temperature signal (T_ref) and a function of the inlet and outlet temperature signals (T1, T2);

an integrator having, as its input, the averaged temperature error signal (T_avg_e) and outputting a signal corresponding to the control signal temperature signal (T_c);

selection circuitry within the element controller for selecting as an unconditioned temperature control signal either the input set-point temperature signal (T_set) or the output signal from the integrator; and an output stage circuit conditioning the unconditioned temperature control to generate the temperature control signal (T_c).

19. An arrangement as in claim 18, further comprising:

a downstream temperature sensor generating a measured downstream temperature signal (T4) corresponding to the temperature of the flowing material after it exits the metal block, the downstream temperature signal (T4) forming an additional one of the input signals to the element controller;

in which the measured downstream temperature signal is the downstream material temperature value.

20. An arrangement as in claim 18, further comprising an estimator generating an estimated downstream material temperature signal (T4_est), the estimated downstream temperature signal forming the downstream material temperature value.

* * * * *